United States Patent [19]

Karpen

[11] 4,128,487

[45] Dec. 5, 1978

[54] STABILIZATION OF SODIUM/POTASSIUM SILICATE-CONTAINING COATING BATH

[75] Inventor: William L. Karpen, Reading, Pa.

[73] Assignee: Carpenter Technology Corporation, Reading, Pa.

[21] Appl. No.: 868,113

[22] Filed: Jan. 9, 1978

[51] Int. Cl.[2] ..... C10M 1/10; C10M 3/02; C10M 5/02; B21B 45/02

[52] U.S. Cl. ..... 252/28; 72/42; 252/49.5; 252/397

[58] Field of Search ..... 252/28, 49.5, 397; 72/42

[56] References Cited

U.S. PATENT DOCUMENTS 4,043,924 8/1977 Fraver ..... 252/28

4,088,585 5/1978 Karpen ..... 252/28

*Primary Examiner*—Irving Vaughn

*Attorney, Agent, or Firm*—Edgar N. Jay

[57] ABSTRACT

A coating bath containing sodium and/or potassium silicate is stabilized and its useful life prolonged by the additions of sodium or potassium hydroxide in amounts at least substantially equal to that required to compensate for the amounts of $CO_2$ or $CO_3$ anions introduced into the bath which, in reacting with the hydroxide formed by the hydrolysis of the silicate to form carbonates, upsets the hydrolysis equilibrium leading to further hydrolysis of the silicate. Similarly, a quantity of hydroxide is added to compensate substantially for other reactive species which significantly affect the hydrolysis equilibrium of the silicate.

7 Claims, No Drawings

STABILIZATION OF SODIUM/POTASSIUM SILICATE-CONTAINING COATING BATH

BACKGROUND OF THE INVENTION

This invention relates to lubricating coatings for use on metallic workpieces during forming processes and, more particularly, to a method for stabilizing and prolonging the effectiveness of a coating-forming bath containing sodium and/or potassium silicate.

A coating bath of the type to which the present invention is directed, that is, one containing sodium and/or potassium silicate is described in detail and claimed in the copending application of the present applicant, Ser. No. 631,732, filed Nov. 13, 1975, assigned to the assignee of the present application, and now U.S. Pat. No. 4,088,585, granted on May 9, 1978. The entire disclosure of said application Ser. No. 631,732 is expressly incorporated here by reference and, therefore, will not be repeated here. However, it may be noted here that coating formulations provided in accordance with said copending application on a commercial production scale have been used with outstanding success. For example, a production scale coating bath containing upwards of 1,000 gallons (3,785 liters) was used over a period of eight months to coat more than 530,000 lb (240,000 kg) of wire, which in the form of coils, was dipped into the bath. During that eight-month period, water and the aliquot portions of the bath ingredients calculated from the amount of coating material removed from the bath in the coating process, were from time-to-time added to maintain the desired minimum depth and content of the coating bath. After completion of eight months of successful coating operations, the coatings formed on coils thereafter dipped in the bath showed less than optimum properties, particularly in that the adherence of the coating to the wire substrate left much to be desired.

Such deterioration in the coating bath, though occurring relatively slowly and after prolonged use, nevertheless involves substantial expense as may be most readily appreciated when the cost of the molybdenum disulfide involved is taken into account. On the other hand, when the wire to be coated is drawn as one or more strands through a relatively small container, the problems associated with the long-term exposure of a relatively large coating bath to the ambient atmosphere or conditions encountered in the usual commercial production of coated wire treated in the form of coils, would not be expected to be encountered. Nevertheless, when, as may often be most convenient, the coating is applied using a coil-dipping technique, the inconvenience and expense of discarding a substantial amount of bath formulation and providing a bath made from new ingredients is a disadvantage.

SUMMARY OF THE INVENTION

It is, therefore, a principal object of this invention to provide a process for maintaining the effectiveness of a coating-forming bath containing sodium and/or potassium silicate so that the coating bath can be used and renewed indefinitely.

A more specific object of this invention is to provide such a process for maintaining and prolonging indefinitely the effectiveness of a coating composition containing $MoS_2$, hydroxyethyl cellulose, and sodium and/or potassium silicate.

In accordance with a preferred embodiment of the present invention, finely divided $MoS_2$ powder is mixed in water with water soluble hydroxyethyl cellulose and sodium or potassium silicate. A small amount of pine oil may also be added as a biocide and defoaming agent. As thus far described, the coating composition will be recognized as being identical to that described in said copending patent application, and the details thereof need not be repeated here having been incorporated here by reference. The present invention stems from the discovery that the deterioration in the desired properties of the coating formed from an open bath of coating composition into which coils of wire are dipped, results primarily from a continuing reaction which is believed to take place between the sodium hydroxide (NaOH), formed in the bath of coating composition, $CO_2$ available from the ambient atmosphere or elsewhere, and $CO_3$ anions available from make-up water or elsewhere. As is well known, NaOH has an affinity for $CO_2$ or $CO_3$ anions and readily reacts with it to form sodium carbonate ($Na_2CO_3$) and to the extent that $Na_2CO_3$ is formed, it alters the equilibrium of the bath composition in a direction to cause further hydrolysis of the sodium silicate to produce an amount of NaOH equal to that required to reestablish equilibrium. The same is believed to apply when potassium silicate replaces all or part of the sodium silicate used. The reactions proceed more or less continuously, and it is believed that the resulting transformation of the silicate to higher polysilicate forms results in a product having inferior properties, particularly bonding capabilities, as compared to the starting materials.

It has been found, in accordance with the present invention, that the silicate hydrolization process is reversible, and the starting equilibrium conditions can be stabilized or essentially substantially restored by taking into account and adding from time-to-time the amount of hydroxide consumed in the carbonate reaction. In this way, the desired outstanding properties of the coating composition are maintained indefinitely and no longer become degraded with the increasing age of the bath because of the loss of NaOH or KOH to form $Na_2CO_3$ or $K_2CO_3$. It has also been found that the resulting accumulation of carbonate in the coating bath and, consequently, in the coating formed on the workpieces is inert and does not detract from the desired coating properties.

It has also been found that when, as may often be the case, the metallic workpieces undergoing coating have a residue of active surface-treating reagents present on its surface, such reagents may also react with sodium and/or potassium hydroxide and thereby further, albeit to a lesser extent, affect the bath composition equilibrium in the direction to cause further hydrolysis of the silicate. Thus, when acids and metal salts, such as may result from the action of acids on the metal workpieces, are carried into the coating bath, the concentrations, though extremely low during the early stages in the use of a coating bath, steadily increase with use and, unless adjusted for, will also eventually significantly shift the coating bath equilibrium in the direction to cause excessive hydrolysis of the silicate.

Thus, in accordance with the present invention, sufficient sodium and/or potassium hydroxide is added periodically or from time-to-time to the silicate-containing coating bath to react with substantially all the $CO_2$ and other reactive species introduced into the bath so as effectively to stabilize the hydrolysis equilibrium of the coating bath.

DESCRIPTION OF THE PREFERRED EMBODIMENT

The present invention will now be described in detail in connection with the coating bath composition of said application used to coat metallic workpieces in the form of wire coils which are dipped into the coating bath, the wire having been first prepared for coating in a bath which, after rinsing, left a residue of hydrochloric acid and metallic salts thereof on the wire as it entered the coating bath. However, it is not intended thereby to limit the present invention.

After a period of dipping wire coils into a coating bath, it was determined by calculations that the bath contained about 9.03 weight percent (w/o) sodium silicate solution ("RU" manufactured by Philadelphia Quartz Co. containing about 33.2 w/o $SiO_2$ and 13.85 w/o $Na_2O$ for an $SiO_2$ to $Na_2O$ ratio of 2.40 and about 52.95 w/o water) about 17.06 w/o $MoS_2$, about 0.97% hydroxyethyl cellulose (HEC, manufactured by Hercules, Inc. as Natrosol 250 LR), and the balance substantially water except for an amount of pine oil so small that it can be ignored in these calculations. It was analytically determined that the bath then contained about 0.3 w/o $CO_2$, or 40.6 lb (18.42 kg) of the remaining bath was $CO_2$. It is believed that the reaction between the hydroxide and $CO_2$ may be written as $$2NaOH + CO_2 = Na_2CO_3 + H_2O \text{ or}$$

$$2KOH + CO_2 = K_2CO_3 + H_2O$$

Using 44.0099 as the molecular weight of $CO_2$ and 79.99434 as the molecular weight of 2NaOH, the amount of NaOH required stoichiometrically to react with the 40.6 lb of $CO_2$ is found to be 73.8 lb (33.5 kg).

The chloride content of the remaining portion of the bath was also determined analytically and was found to be 0.31 w/o or 42 lb (19 kg) or 43.2 lb (19.6 kg) HCl. Using the reaction $$HCl + NaOH = NaCl + H_2O$$

the stoichiometric amount of NaOH required to react with the amount of chloride present is found to be 47.4 lb (21.5 kg).

From the foregoing, it is evident that combining the 73.8 lb of NaOH consumed in the carbonate reaction with the 47.4 lb consumed in chloride reaction gives a total of 121.2 lb (55 kg) of NaOH required to restore the equilibrium of the silicate hydrolysis reaction to the starting condition. In practice, the additions of hydroxide are made as frequently as practical so that the quantity required to be added in each instance would be substantially smaller, preferably about 5 to 15 lb (2.3–6.8 kg). For example, if it be assumed that as a result of previous analysis and calculations, 110 lb (50 kg) of NaOH had been added to the bath prior to the analyses and calculations just described, the subtraction of 110 lb from 121.2 lb gives 11.2 lb (5.1 kg) as the amount of NaOH to be added at this time. It is also desirable in practice to add some small excess of hydroxide to ensure maximum stabilization.

Depending upon the treatments to which the workpieces are exposed prior to coating, other anions may be introduced into the coating composition in addition to or in place of the chloride anions. For example, when sulfuric acid, nitric acid, hydrofluoric acid or others are used alone or in combination in treating the workpieces before coating, additional anions are present reactive with the hydroxide and are to be taken into account. The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. The method of stabilizing a coating composition containing an aqueous solution of at least one of sodium and potassium silicate which includes the steps of determining the amount of reactive species introduced into the coating composition during use which are reactive with MOH, M being at least one of sodium and potassium, and then adding to the coating composition an amount of MOH at least substantially equal to the amount thereof required to react stoichiometrically with said amount of reactive species.

2. The method set forth in claim 1 in which said reactive species include $CO_2$ or $CO_3$ anions.

3. The method set forth in claim 1 in which said reactive species include chloride anions.

4. The method set forth in claim 2 in which said reactive species further include chloride anions.

5. The method of stabilizing a coating composition containing an aqueous solution of at least one of sodium and potassium silicate which includes the steps of determining the amount of $CO_2$ or $CO_3$ anions introduced into the coating composition, and adding to the coating composition an amount of MOH at least substantially equal to the amount thereof required to react stoichiometrically with said amount of $CO_2$ or $CO_3$ anions, M being at least one of sodium and potassium.

6. The method set forth in claim 5 which includes the steps of determining the amount of chloride anion introduced into the coating composition, and adding to the coating composition a further amount of MOH at least substantially equal to the amount thereof required to react stoichiometrically with said amount of chloride anion.

7. The method set forth in claim 6 in which said coating composition is a composition for forming a dry lubricating film on metallic workpieces and further contains powdered $MoS_2$ and hydroxyethyl cellulose.

* * * * *